US005370749A

United States Patent [19]

Ames et al.

[11] Patent Number: 5,370,749

[45] Date of Patent: Dec. 6, 1994

[54] AMORPHOUS METAL ALLOY STRIP

[75] Inventors: S. Leslie Ames, Sarver, Pa.; Vilakkudi G. Veeraraghavan, Endicott, N.Y.

[73] Assignee: Allegheny Ludlum Corporation, Pittsburgh, Pa.

[21] Appl. No.: 922,459

[22] Filed: Jul. 30, 1992

Related U.S. Application Data

[63] Continuation of Ser. No. 235,064, Feb. 17, 1981.

[51] Int. Cl.[5] ..... C22C 38/02; C22C 45/02

[52] U.S. Cl. ..... 148/304; 420/121

[58] Field of Search ..... 148/304; 420/121

[56] References Cited

U.S. PATENT DOCUMENTS

| | | | |
|---|---|---|---|
| Re. 29,989 | 5/1979 | Polk | 428/661 |
| 3,297,436 | 1/1967 | Duwez . | |
| 3,856,513 | 12/1974 | Chen et al. . | |
| 4,056,411 | 11/1977 | Chen et al. . | |
| 4,079,430 | 3/1978 | Fujishima et al. | 360/126 |
| 4,134,779 | 1/1979 | Ray et al. . | |
| 4,142,571 | 3/1979 | Narasimhan | 164/88 |
| 4,150,981 | 4/1979 | O'Handley . | |
| 4,152,144 | 5/1979 | Hasegawa . | |
| 4,152,147 | 5/1979 | Hasegawa et al. . | |
| 4,190,438 | 2/1980 | Aso et al. . | |
| 4,201,837 | 5/1980 | Lupinski et al. | 428/457 |
| 4,217,135 | 8/1980 | Luborsky et al. . | |
| 4,219,355 | 8/1980 | DeCristofaro et al. . | |
| 4,298,409 | 11/1981 | DeCristofaro et al. | 148/108 |
| 4,409,041 | 10/1983 | Datta et al. | 148/304 |
| 4,437,907 | 3/1984 | Sato et al. | 148/304 |
| 5,035,755 | 7/1991 | Nathasingh et al. | 148/304 |

FOREIGN PATENT DOCUMENTS

| | | |
|---|---|---|
| 81107559.7 | 9/1981 | European Pat. Off. . |
| 7910034 | 4/1979 | France . |
| 7910035 | 4/1979 | France . |
| 2915737 | 11/1979 | Germany . |

OTHER PUBLICATIONS

K. Hoselitz, "Magnetic Iron-Silicon-Boron Metallic Gases" Rapidly Quenched Metals III, vol. 2, pp. 245–248 (1978).

der Broeder et al. "Magnetization Reversal in $Fe_{80}B_{1.5}Si_5$ Metallic Glass With Large Uniaxial Magnetostrictive Anistropy", J. Appl. Phys. 50(11), Nov., 1979 pp. 7116–7119.

Mitchell et al. "ΔE Effect and Magnetomechanical Coupling Factor in $Fe_{80}B_{20}$ and Fe78Si10B12 Glassy Ribbons", IEEE Trans. on Mag. vol. MAG14, No. 6, Nov. 1978, pp. 1169–1171.

W. Jaschinski et al., "Magnetic Properties of Amorphous FeSiB Alloys", Fried. Krupp GmbH, Krupp Research Institute, 4300 Essen (1980), and English language translation.

Internal AlliedSignal Inc. "Materials Research Center Memorandum", dated Feb. 2, 1978, entitled Evaluation of Casting Behavior of Fe-B-Si Alloys.

Schurer et al. "Mossbauer Study of Amorphous $Fe_{78}B_{12}Si_{10}$", Physical Review B, vol. 20, No. 11, Dec. 1, 1979 pp. 4660–4664.

Inoue et al. "Compositional Effect on Crystallization of (Fe, Ni, Co)-Si-B Amorphous Alloys", Japan Institute of Metals Journal, vol. 42, No. 3 pp. 294–303 (1978).

*Primary Examiner*—Deborah Yee

*Attorney, Agent, or Firm*—Patrick J. Viccaro

[57] ABSTRACT

An amorphous metal alloy strip is disclosed having a width greater than about one inch and a thickness less than about 0.003 inch, this alloy consists essentially of 77 to 80 atomic percent iron, 12 to 16 atomic percent boron and 5 to 10 atomic percent silicon with incidental impurities. The strip has a 60 cycle per second core loss of less than about 0.100 watts per pound at 12.6 kilogauss, saturation magnetization of at least 15 kilogauss, and a coercive force of less than about 0.04 oersteds. Such alloy is further characterized by increased castability and the strip produced therefrom exhibits at least singular ductility. A method of producing such optimum strip is also disclosed.

17 Claims, 2 Drawing Sheets

AMORPHOUS METAL ALLOY STRIP

This is a continuation of application Ser. No. 06/235,064, filed Feb. 17, 1981.

BRIEF SUMMARY OF THE INVENTION

The present invention relates to a new and improved amorphous metal alloy strip material and a method of making such strip material. More particularly, the metal alloy strip of the present invention has a width greater than about one inch, a thickness less than about 0.003 inch and consists essentially of 77–80% iron, 12–16% boron and 5–10% silicon, based on atomic percentages. The strip material of the present invention exhibits improved magnetic and physical properties.

With the increased research and development activity in the area of amorphous strip materials, it has become apparent that certain amorphous strip materials may possess the magnetic and physical properties that would enhance the use of such materials in electrical applications such as transformers, generators or electric motors. The use of amorphous strip material in a laminated article for electrical applications is disclosed by the Assignee of the present invention in U.S. patent application Ser. No. 073,812, filed Sept. 10, 1979.

An established alloy composition for strip material used in transformers is $Fe_{80}B_{20}$. It is known, however, that such alloy is difficult to cast in the amorphous form and tends to be unstable. The addition of silicon and/or carbon to such iron-boron alloy has permitted the rapid casting of strip material used for electrical applications. However, a continuing objective in this area is to identify an optimum alloy composition for amorphous strip for electrical applications.

Minor differences in chemical composition may have significant effects on the castability of amorphous strip material and on the magnetic, physical and electrical properties of such strip. Therefore, an optimum alloy composition for amorphous strip material for use in electrical applications is desired in the strip casting art.

Numerous alloys and alloy ranges for amorphous materials are disclosed in the prior art. For example, U.S. Pat. No. 3,297,436 discloses amorphous alloys of gold-silicon, silver-copper, silver-germanium, and palladium-silicon among others. The patentee, Professor Pol E. Duwez, recognized that the amorphous product may inter alia, have improved properties including improved electronic and magnetic properties when compared to conventional alloys. U.S. Pat. No. 3,856,513 discloses an extremely broad composition for amorphous metal alloys under the general formula $M_{60-90}Y_{10-30}Z0.1-15$ where M is iron, nickel, chromium, cobalt, vanadium or mixtures thereof, Y is phosphorus, carbon, boron, or mixtures thereof, and Z is aluminum, silicon, tin, antimony, germanium, indium, beryllium and mixtures thereof.

With regard to specific developments in the area of amorphous metal alloys having improved magnetic properties, the patents noted below may also be of interest.

U.S. Pat. No. 4,056,411 pertains to alloys for magnetic devices with low magnetostriction including 3–25% iron and 7–97% cobalt. U.S. Pat. No. 4,134,779 discloses an iron-boron ferromagnetic alloy with high saturation magnetization. U.S. Pat. No. 4,150,981 relates to an iron-nickel-cobalt-boron alloy having high saturation induction and near zero magnetostriction.

U.S. Pat. No. 4,154,144 discloses various alloys, none of which contain silicon, which are said to possess high permeability, low magnetostriction, low core loss, and high thermal stability. U.S. Pat. No. 4,154,147 discloses an iron-boron glassy magnetic alloy which contains 2–10% beryllium, and U.S. Pat. No. 4,190,438 pertains to an iron-boron-silicon magnetic alloy which contains 2–20% ruthenium. U.S. Pat. No. 4,197,146 discloses an amorphous metal consisting of aligned flakes of a particular alloy composition. U.S. Pat. No. 4,217,135 relates to an iron-boron-silicon alloy with a high crystallization temperature and low coercivity. U.S. Pat. No. 4,219,355 pertains to an $Fe_{80-82}B_{12.5-14.5}Si_{2.5-5.0}C_{1.5-2.5}$ alloy composition. Such developments in the art shows that optimization of alloy compositions of amorphous strip material, such as for electrical applications, is a continuing objective in the art of rapid solidification of amorphous strip materials.

The present invention may be summarized as providing a novel amorphous metal alloy strip having a width greater than about one inch and a thickness less than about 0.003 inch. The alloy of the present invention consists essentially of 77 to 80 atomic percent iron, 12 to 16 atomic percent boron and 5 to 10 atomic percent silicon with no more than incidental impurities. This narrow composition for the strip material of the present invention, which is not disclosed or suggested as an optimum alloy by the prior art, is characterized by a 60 cycle per second core loss of less than about 0.100 watts per pound at 12.6 kilogauss, saturation magnetization of at least 15 kilogauss, and a coercive force of less than about 0.04 oersteds. Such alloy is also characterized by increased castability, and the strip produced therefrom exhibits at least singular ductility, as defined below. A method of producing such ductile strip material is also provided wherein a continuous stream of molten metal consisting essentially of 77 to 80 atomic percent iron, 12 to 16 atomic percent boron and 5 to 10 atomic percent silicon, is delivered through a slot in a nozzle, the slot having a width of at least 0.010 inch, and onto a casting surface disposed within 0.120 inch of the nozzle and moving past the nozzle at a speed of 200 to 10,000 linear surface feet per minute, solidifying the strip on the casting surface and separating the strip from the casting surface.

Among the advantages of the present invention is the provision of an amorphous strip material having a unique, narrow range of iron, boron and silicon, which makes the strip material particularly advantageous for electrical applications such as in distribution transformers, and the like.

A particular objective of this invention is the identification of an alloy composition for predominately amorphous strip material which exhibits excellent magnetic properties, especially in terms of minimized core loss values, which makes such strip useful for electrical applications.

In addition to the beneficial magnetic and electrical properties of the strip of the present invention, another objective is to provide an alloy composition which is able to be rapidly quenched and solidified from the molten state into strip form with a high degree of castability. The ductility and physical integrity of the resultant cast strip is found to be particularly advantageous.

These and other objectives and advantages of the present invention will be more fully understood and appreciated with reference to the following detailed description and the drawing.

DETAILED DESCRIPTION

As mentioned above, a conventional composition for transformer alloy is 80% iron and 20% boron. Such alloy composition is difficult to rapidly quench into amorphous strip material, and such alloy tends to be unstable. It has been found that slight modifications of the basic composition, in accordance with the present invention, beneficially affects the ability of the alloy to be cast into strip material, i.e. castability, and beneficially affects the magnetic, electrical and physical properties of such strip material.

Figure 1:
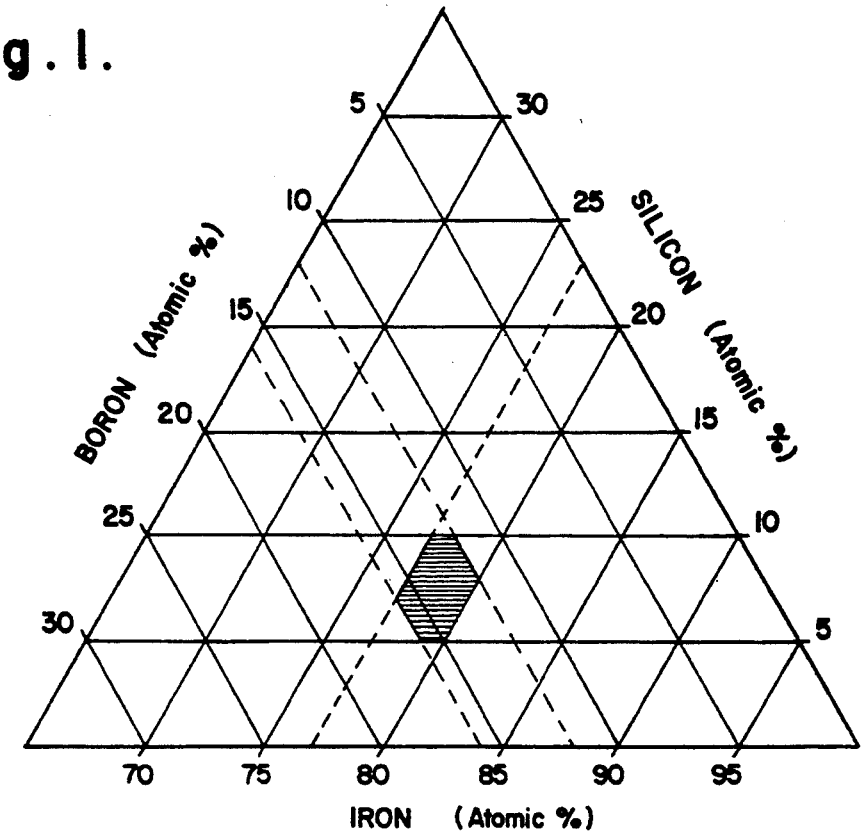
FIG. 1 is a ternary diagram showing the composition range of the iron-boron-silicon alloy of the present invention.

The alloy composition of the present invention, as illustrated in the ternary diagram of FIG. 1, consists essentially of:

| Element | Atomic % |
|---|---|
| iron | 77–80% |
| boron | 12–16% |
| silicon | 5–10% |

It should be understood that the total composition of the alloy of the present invention must equal 100 atomic percent. Such alloy may contain no more than incidental impurities. The strip of the present invention which has the above composition, must be rapidly cast from the molten to the solid state, in order to attain the requisite amorphous condition. Additionally, the alloy must be cast into strip material having a width greater than or equal to about one inch and a thickness less than 0.003 inch for use in electrical applications such as transformers. It follows that the requisite magnetic and electrical properties of the strip, as discussed below, must be present in the strip form.

Amorphous metallic strip of the present invention, includes rapidly quenched strip which is at least 75% amorphous. It should be understood that multiple strips of a higher degree of amorphousness, such as 98%, may be joined at a longitudinal crystalline joint to form a strip which, overall, is at least 75% amorphous.

The ability to attain the amorphous condition in casting the molten alloy of the present invention into strip material is, of course, important. Typically, amorphous strip material is cast by continuously delivering a molten stream or pool of metal through a slotted nozzle located within about 0.120 inch of a casting surface, and onto the casting surface which typically moves at a rate of about 200 to 10,000 linear surface feet per minute past the nozzle. The casting surface is typically the outer peripheral surface of a water cooled, copper alloy wheel having a circumference greater than about six (6) feet. Rapid movement of the casting surface tends to draw a continous thin layer of the metal from the pool or puddle. This layer rapidly solidifies at a quench rate initially on the order of about $1\times10^6$ degrees Centrigrade per second, into strip material. Typically, the alloy is cast at a temperature above about 2400° F. onto a casting surface having an initial temperature usually reflecting ambient temperature, such as about 60° to 90° F. It is understandable that the surface temperature increases after the initiation of the strip casting operation. The strip must be rapidly solidified on the casting surface to obtain the amorphous condition. Ideally, the strip is quenched to below the solidification temperature of about 1900°–2100° F. after only about 0.1 inch retention distance on the surface. And the strip should be quenched to below the crystallization temperature, of about 750°–800° F. after less than about 1.5 inch retention distance on the casting surface. The strip is solidified on the casting surface, and is separated therefrom after solidification. A detailed description of an apparatus for rapidly casting strip material is contained in the present Assignee's copending U.S. patent application Ser. No. 148,441 filed May 9, 1980, the entire subject matter of which is incorporated herein by reference.

The alloy composition of the present invention is considered to provide an optimization of the requisite properties of the strip material. It is understandable that certain properties may have to be sacrificed at the expense of obtaining other properties, but the composition of the present invention is found to constitute the ideal balance among such requisite properties especially for producing wide strip for electrical applications.

For example, the following properties are desired for strip material of the present invention:

1. The core loss should be as low as possible. Maximum core loss is set at about 0.100 watts per pound at 60 cycles per second, at 12.6 kilogauss. More preferably, such core loss value is below about 0.090 watts per pound, and significant values approaching 0.060 have been obtained with the alloy strip of the present invention. Throughout this application, the core loss values pertain to a frequency of 60 Hertz.
2. The magnetic saturation should be as high as possible. A saturation value of 15,000 gauss is considered a minimum for the alloy strip of the present invention.
3. The strip should be predominately, at least 75%, amorphous.
4. The strip should be ductile.
5. The molten alloy should be easily cast into strip.
6. The strip should be thermally stable to permit stress relief to optimize magnetic properties and to retain such properties during the service life of the strip.

The elements in the composition of the present invention contribute to these properties, sometimes in conflicting proportions. To maximize magnetic saturation, the amount of iron should be as high as possible. In particular, the amount of iron must be at least 77 atomic percent in order to obtain magnetic saturation of at least 15,000 gauss. It is also found that the iron content does not have to exceed 80% and yet the requisite magnetic saturation can be obtained. Formerly, it was thought that the iron content must exceed 80% to obtain adequate magnetic saturation values for strip material used in electrical applications. By keeping the iron content below 80%, the other major constituents, namely boron and silicon, can be provided in increased amounts.

To obtain a strip material having increased thermal stability, the silicon amount should be maximized. Greater amounts of silicon permit the strip material to be heat treated at higher temperatures without causing crystallization, i.e., silicon raises the crystallization temperature of amorphous strip material. Being able to heat treat to higher temperatures is useful in relieving internal stresses in the strip, which improves the magnetic properties. However, the amount of silicon is usually of secondary importance and is, therefore, dependent upon the amount of iron and boron which must be present in the alloy. Silicon also tends to promote amorphousness, but silicon is considered to be on the order of about one-fifth as effective as is boron in promoting amorphousness.

In order to obtain the requisite amorphous condition, the amount of boron in the alloy should be maximized, provided that the casting parameters, such as quench rate variables, remain relatively constant. It is noted that the requisite amorphous condition may be obtained using strip casting methods having a relatively lower quench rate, such as on the order of about $1\times10^5$ degrees Centigrade per second, if the boron amount is increased. In conflict with the desire for amorphousness is the desire to increase the ductility of the strip. Within an alloy having 77–80 atomic percent iron, lower boron values are found to increase the ductility of the strip. However, as the boron value falls below about 13 atomic percent, in the alloy of the present invention, the strip tends to become more crystalline. The range of 12–16 atomic percent boron has been found to provide the necessary properties in the strip of the present invention. In particular, any minor crystallinity which might occur at the low end of this boron range can still result in acceptable magnetic properties in the strip. Conversely, any sacrifice of ductility at the upper end of this boron range is more than compensated by an improvement in magnetics. The actual location where one operates within the 12–16 atomic percent boron range of the present invention, depends upon the overall requirements necessitated by the particular application for the strip material.

Below are various minimum target values for strip material within the alloy range of the present invention and actual values attained with one preferred chemistry:

| | Composition | |
|---|---|---|
| | $Fe_{77-80}B_{12-16}Si_{5-10}$ | $Fe_{79}B_{15}Si_6$ |
| Core Loss (watts per pound 60 Hz at 12.6 kG) | less than 0.100 | .063 |
| Magnetic Saturation (kG) | greater than 15 | 16 |
| Amorphousness | greater than 75% | 100% |
| Ductility | at least singularly | doubly ductile |
| Thermal Stability (% increase in Core Loss after 20 days aging) | less than 5% | less than 2% |
| Coercive Force (Oersteds) | less than 0.04 | 0.03 |

Applicants emphasize the excellent results actually obtained with the strip material of the present invention. Core losses of 0.063 watts per pound are considered extraordinary for wide, high saturation amorphous strip materials. There is no evidence in the art that other alloy compositions for wide, high saturation amorphous strip material can provide such significant magnetic and electrical properties. Identification of the alloy composition that can successfully obtain such low core loss values, of less than 0.100, preferably less than 0.090 and most preferably below 0.065 watts per pound, now provides the information considered necessary to manufacture ideal strip material for electrical applications, such as three inch, six inch or wider strip having a gage less than 0.003 inch for distribution transformers or the like. It should be noted that strip widths of 24, 30 inches, or more, are also comprehended by the present invention.

The following alloys were cast into strip in accordance with the present invention, were annealed at 350° C. and slowly cooled in a magnetic field of 10 oersteds with the following results:

| Composition (Atomic %) | | | Coercive Force $H_c$ | Induction $B_1$ @ 1 Oersted | Saturation $B_s$ | Core Loss (WPP) 60 Hz at |
|---|---|---|---|---|---|---|
| Fe | B | Si | (Oersted) | (Gauss) | (Gauss) | 12.6 kg |
| 77.6 | 15.9 | 6.5 | .034 | 14,100 | 15,800 | .066 |
| 78.0 | 15.6 | 6.4 | .035 | 13,800 | 15,800 | .076 |
| 78.1 | 12.4 | 9.5 | .051 | 11,200 | 15,400 | .105 |
| 78.5 | 15.8 | 5.7 | .030 | 14,500 | 16,000 | .063 |
| 78.9 | 13.7 | 7.4 | .034 | 14,900 | 15,700 | .065 |
| 79.1 | 12.4 | 8.5 | .048 | 14,100 | 15,700 | .083 |
| 79.2 | 12.4 | 9.4 | .050 | 14,000 | 16,000 | .086 |

Alloys having compositions outside the claimed range for the present invention were also cast into strip in accordance with the present invention, were annealed at 350° C. and slowly cooled in a field of 10 oersteds with the following results:

| Composition (Atomic %) | | | Coercive Force $H_c$ | Induction $B_1$ @ 1 Oersted | Saturation $B_s$ | Core Loss (WPP) 60 Hz at |
|---|---|---|---|---|---|---|
| Fe | B | Si | (Oersted) | (Gauss) | (Gauss) | 12.6 kg |
| 81.5 | 12.3 | 6.3 | .048 | 900 | 15,500 | .839 |
| 82 | 11.9 | 6.1 | .049 | 1,700 | 15,900 | .520 |

These results demonstrate that even though the coercive force and the magnetic saturation values may indicate that the strip material is acceptable, such values do not assure acceptable core loss values. In particular, strip with extremely high core loss values as shown above, probably due to partial crystallinity, would not be acceptable for electrical applications, such as in distributor transformers.

The alloy composition of the present invention should provide a strip which is ductile rather than brittle. Such strip must be separated from the casting surface, coiled and subjected to various auxiliary handling and processing operations prior to actual assembly into a transformer core, or the like, and therefore must have sufficient strength and ductility not to break or crack during such handling.

Ductility of amorphous strip is gauge dependent, with heavier gauges tending to be more brittle. This phenomena is well known as taught by K. Hoselitz, Magnetic Iron-Silicon-Boron Metallic Glasses, Conference on Rapidly Quenched Materials III, Volume 2, Pages 245–248 (1978). However, if significant crystallinity occurs, such as in excess of 25%, the material is consistently brittle regardless of gauge or chemistry.

For the present invention, the ductility of the amorphous strip material may be determined by a relatively simple, yet qualitative, bend test. If the strip fractures when bent transversely, upon itself, i.e., a 180° bend, in either direction, the strip is deemed to be brittle. If the strip can be bent upon itself into a non recoverable, permanent bend, without fracturing, in the direction that the strip was solidified on the casting surface, but the strip fractures when bent in the opposite direction, the strip is said to be singularly ductile. For most electrical applications singular ductility should be adequate. If the strip can be bent transversely upon itself in both directions into a nonrecoverable, permanent bend without fracture, the strip is said to be doubly ductile. Double ductility is the optimum condition for the strip material. However, singular ductility is a minimum property for the strip of the present invention. Such bend tests can be easily performed by creasing the strip across the transverse width of the strip after the strip is folded upon itself. The nonrecoverable, permenant crease is easily provided in ductile strip by manually pinching or squeezing the strip at the fold.

As explained above, an amorphous strip is found to have increased ductility at lower boron levels. The strip of the present invention is found to be singularly ductile within the composition range of 77–80% iron, 12–16% boron and 5–10% silicon, based on atomic percentages. To obtain the optimum double ductility, there may be a limitation on the gauge with respect to the boron content. For example, by keeping the proportion of iron to silicon at a ratio of about 13:1 and adjusting the boron content, the resultant strip has been found to be doubly ductile at the following approximate maximum gauges:

| Atomic Percent Boron | Approximate Maximum Gauge Having Double Ductility |
|---|---|
| 12–13.5% | .0025 inch |
| 13.5–14.5% | .00175 inch |
| 14.5–16% | .001 inch |

Figure 2:
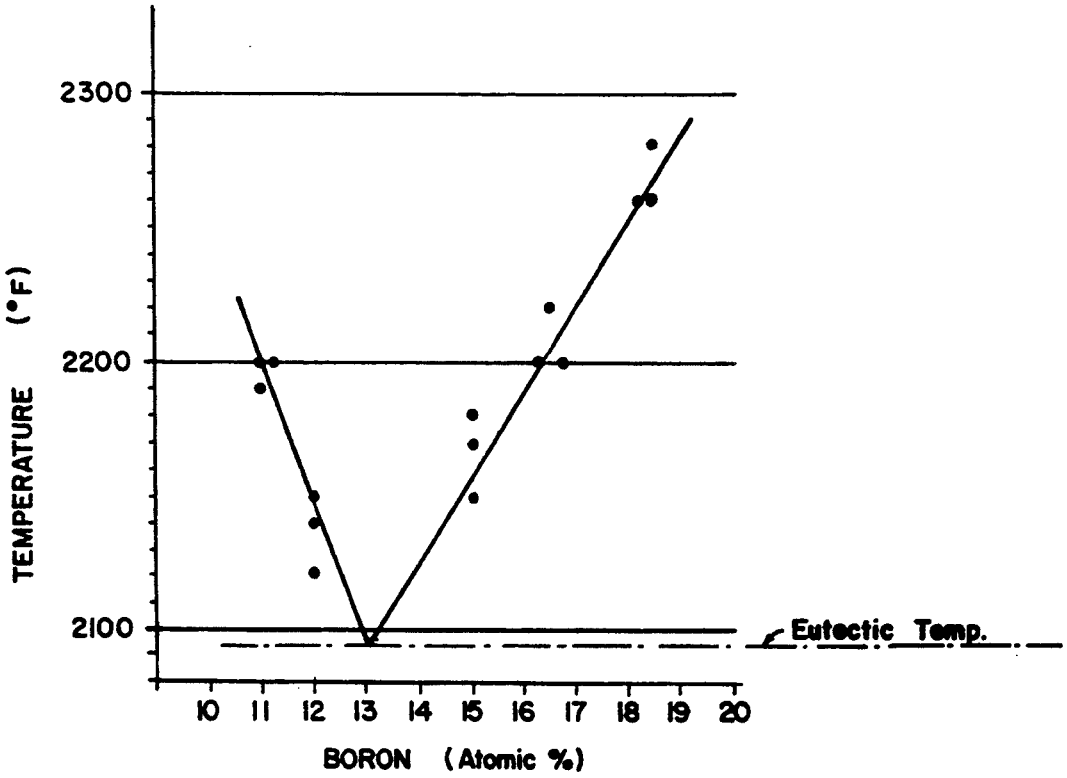
FIG. 2 is an exemplary, partial phase diagram of iron-boron-silicon alloy compositions.

The alloy composition of the present invention must be cast from the molten state into amorphous strip material. The alloys within the composition range of the present invention are at or near a eutectic composition; that is, the alloys melt at a single temperature or over a relatively narrow temperature range, such as within a temperature range of 150° F. Melting near a eutectic composition is advantageous in casting amorphous strip material. FIG. 2 illustrates an approximate phase diagram for exemplary iron-boron-silicon alloys. The phase diagram is based on alloys having a silicon content of from 5–7 atomic percent, and the phase diagram is illustrated as a function of boron content. The balance of the composition is iron. As shown in FIG. 2, the eutectic temperature is approximately 2100° F., and the alloys of the present invention, having 12–16 atomic percent boron, melt at a temperature close to the eutectic temperature.

Figure 3:
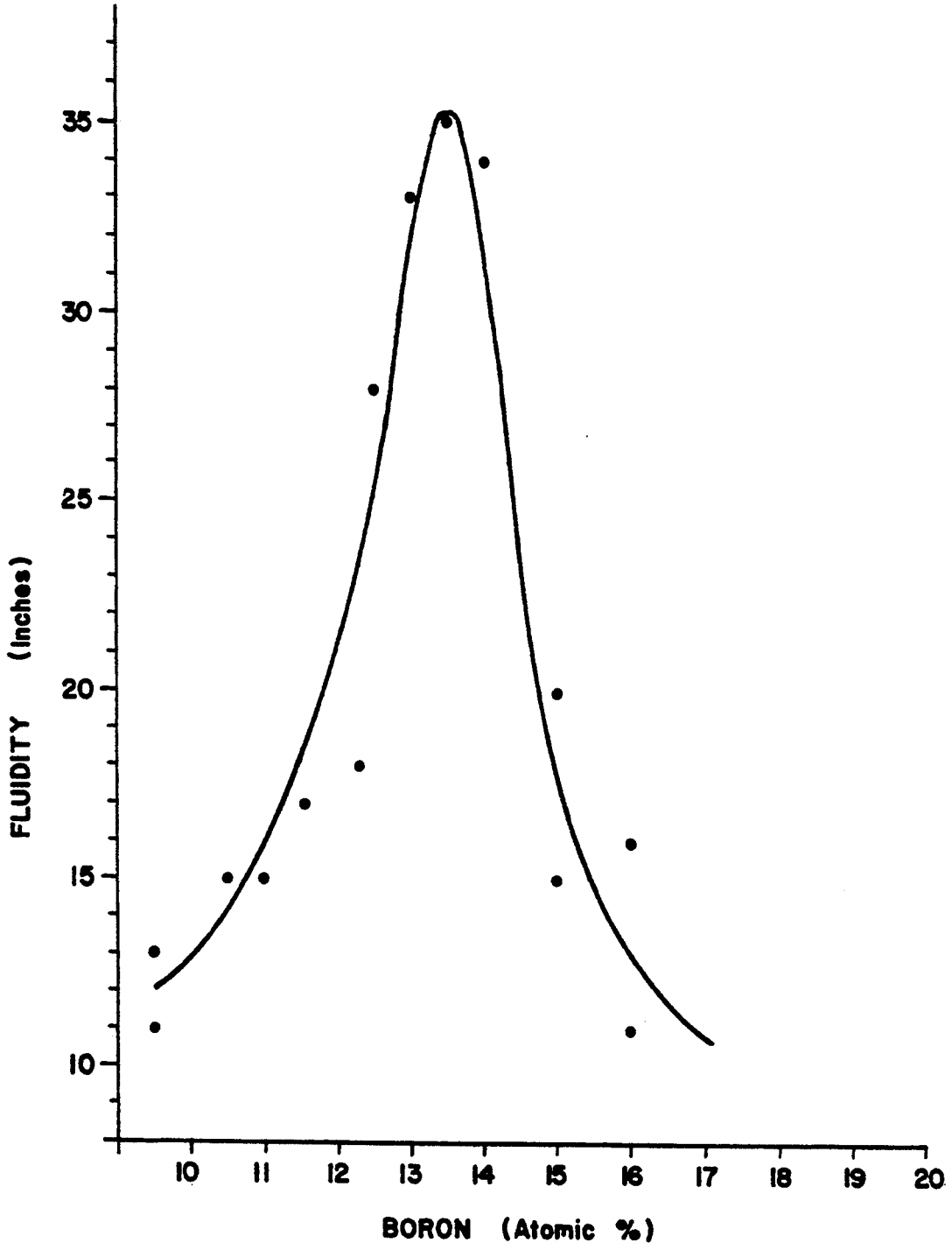
FIG. 3 is a graph illustrating the fluidity of the alloy compositions shown in FIG. 2.

Adequate fluidity is also important to casting molten alloys into wide, amorphous strip material. This fact supports the proposition that compositions in the proximity of the eutectic composition would be ideal for casting purposes. Fluidity data, expressed in terms of inches, from standard suction tube tests, is illustrated in FIG. 3 for the alloys set forth in FIG. 2. Such fluidity data was obtained at an alloy temperature of about 1,250° C. (2,280° F.). The fluidity of the molten alloy may have a bearing on the ability of the alloy to be cast into amorphous strip. The alloy composition of the present invention has been found to be adequately fluid, for strip casting purposes, when maintained in the molten state, typically at a temperature above about 2,095° F. Understandably, the fluidity of the molten alloy is to some extent dependent upon the composition of the alloy. A eutectic composition has been found at a boron content of about 13 to 16 atomic percent. The fluidity, of the molten alloy as determined by the height that the molten alloy rises in a glass tube during suction tube data tests, is found to be greatest at or near such eutectic composition containing about 13 to 16 atomic percent boron. Ideal properties of wide strip of the present invention in terms of ductility and other physical as well as magnetic properties, have been obtained by casting the alloy at or near the eutectic composition. Such preferred alloy compostion consists essentially of 77–79 atomic percent iron, 13–16 atomic percent boron and 5–7 atomic percent silicon. In actual practice the alloy is typically poured into a tundish at a temperature of about 2,600°–2,700° F., and is delivered to the moving casting surface at a temperature of about 2,400°–2,500° F.

As mentioned above, one of the considerations for the alloy composition of the present invention is the stability of the strip, i.e., the resistance to thermal aging. A transformer core material must retain its properties over the life of a transformer, typically 20–25 years. Since transformers operate at higher than ambient temperature, there is a possibility that, over a prolonged period, there may be a thermally activated degradation of the properties of the transformer materials. In the case of conventional silicon steels, such degradation is due to the precipitation of carbon from solution to form carbides which adversely increases the core loss in the transformer. The strip of the alloy composition of the present invention has been found to successfully pass thermal aging tests and exhibit and retain low core loss values, as explained in detail below.

Accelerated aging tests have been developed for silicon steel strip material. As set forth in ASTM Part 44, A340, 1980, Page 7, these tests are:

(a) subject the test material to a temperature of 100° C. for 600 hours.

(b) subject the test material to a temperature of 150° C. for 100 hours.

The usual criterion for acceptable performance is less than five percent (5%) increase in the core loss, at 15,000 gauss, after aging.

The mechanism of any aging or degradation occurring in amorphous metals is expected to be different from that in conventional silicon steel. Changes might occur through incidents ranging from those involving minor rearrangement of atoms in the frozen liquid state, to major rearrangement involving the onset of crystallization. It is known that crystallization of amorphous strip material becomes catastrophically deleterious to the magnetic and electrical properties. To give an adequate indication of the effects of aging on amorphous strip materials the testing times indicated above were extended and magnetic properties in addition to core loss were measured as discussed below.

The following alloy compositions were cast into amorphous strip material having a width of 1.0 inch and a gauge less than 2 mils:

| | Composition (Atomic %) | | |
|---|---|---|---|
| Example | Iron | Boron | Silicon |
| I | 79.0 | 15.3 | 5.8 |
| II | 78.6 | 15.6 | 5.9 |
| III | 78.5 | 15.8 | 5.7 |

-continued

| | Composition (Atomic %) | | |
|---|---|---|---|
| Example | Iron | Boron | Silicon |
| IV | 77.5 | 16.0 | 5.7 |

The strip of Example I was subjected to a magnetic anneal at 350° C. for 4 hours and was cooled at the rate of 50° C. per hour with a magnetic field of 10 oersteds in the sample. The alloy strip samples of Example I were placed in an oven set at a temperature of 100° C. It was found that the oven stabilized at a temperature of 96° C. About once a week over the fourteen (14) week test period, the samples were removed from the oven, allowed to cool to room temperature and were tested. The test results are summarized in Table I below:

TABLE I

| Week: | 0 | 1 | 2 | 3 | 4 | 5 | 6 |
|---|---|---|---|---|---|---|---|
| Hours: | 0 | 168 | 336 | 504 | 672 | 840 | 1008 |
| D.C. B @ 1.0 H | 14200 | 14300 | 14600 | 14300 | 14200 | 14200 | 14200 |
| $B_r$ | 11600 | 11600 | 11700 | 11900 | 11900 | 11900 | 11700 |
| $H_c$ | 0.0490 | 0.0484 | 0.0484 | 0.0488 | 0. 0485 | 0.0484 | 0.0489 |
| B @ 75 H | 16400 | 16400 | 16400 | 16400 | 16300 | 16300 | 16300 |
| 10 KG Irms | 0.00386 | 0.00365 | 0.00366 | 0.00365 | 0.00366 | 0.00371 | 0.00368 |
| W.P.P. | 0.0546 | 0.0527 | 0.0513 | 0.0546 | 0.0546 | 0.0537 | 0.0519 |
| VA/lb | 0.0674 | 0.0637 | 0.0639 | 0.0637 | 0.0639 | 0.0648 | 0.0643 |
| 12.6 KG $I_{rms}$ | 0.00793 | 0.00746 | 0.00772 | 0.00720 | 0.00718 | 0.00788 | 0.00758 |
| W.P.P. | 0.0912 | 0.0898 | 0.0893 | 0.0903 | 0.0907 | 0.0912 | 0.0888 |
| VA/lb | 0.174 | 0.164 | 0.170 | 0.158 | 0.156 | 0.173 | 0.167 |
| 15 KG $I_{rms}$ | 0.0818 | 0.0795 | 0.106 | 0.0750 | 0.0748 | 0.0841 | 0.0790 |
| W.P.P. | 0.143 | 0.142 | 0.141 | 0.142 | 0.142 | 0.142 | 0.141 |
| VA/lb | 2.14 | 2.08 | 2.802 | 1.965 | 1.96 | 2.20 | 2.07 |
| Week: | 8 | 9 | 10 | 11 | 13 | 14 | |
| Hours: | 1334 | 1512 | 1679 | 1847 | 2184 | 2352 | |
| D.C. B @ 1.0 H | 14100 | 14200 | 14200 | 14400 | 14100 | 14100 | |
| $B_r$ | 11700 | 11600 | 11400 | 11600 | 11500 | 11300 | |
| $H_c$ | 0.0486 | 0.0485 | 0.0484 | 0.0489 | 0.0484 | 0.0490 | |
| B @ 75 H | 16200 | 16400 | 16400 | 16300 | 16200 | 16300 | |
| 10 KG Irms | 0.00372 | 0.00371 | 0.00378 | 0.00375 | 0.0038 | 0.00382 | |
| W.P.P. | 0.0542 | 0.0542 | 0.0546 | 0.0546 | 0.0546 | 0.0528 | |
| VA/lb | 0.0650 | 0.0648 | 0.0660 | 0.0655 | 0.0664 | 0.0667 | |
| 12.6 KG $I_{rms}$ | 0.00791 | 0.00791 | 0.00841 | 0.00820 | 0.00848 | 0.00875 | |
| W.P.P. | 0.0917 | 0.0917 | 0.0931 | 0.0926 | 0.0926 | 0.0917 | |
| VA/lb | 0.174 | 0.174 | 0.185 | 0.180 | 0.187 | 0.193 | |
| 15 KG $I_{rms}$ | 0.0847 | 0.0840 | 0.0885 | 0.0871 | 0.0928 | 0.0928 | |
| W.P.P. | 0.143 | 0.143 | 0.144 | 0.143 | 0.143 | 0.138 | |
| VA/lb | 2.22 | 2.20 | 2.32 | 2.28 | 2.43 | 2.43 | |

Based on the acceptance criteria for conventional silicon steel strip materials, i.e., less than a 5% change in WPP core loss at 15 kG, the strip of Example I is considered to be acceptably stable. Note, in particular, the stability of the core loss value shown in Table I.

The strip of Examples II–IV were subjected to aging tests similar to that described above for Example I, at a temperature of 100° C. for 20 days. As with the strip of Example I, Table II below shows that the stability, based on 15 kG WPP core loss, is satisfactory.

TABLE II

| | Aging Test Results for Examples II–IV | | | | | | | | |
|---|---|---|---|---|---|---|---|---|---|
| | $B_1$ | $B_r$ | Hc | 10 kG | | 12.6 kG | | 15 kG | |
| Example | (kG) | (kG) | (Oe) | (W/lb) | (VA/lb) | (W/lb) | (VA/lb) | (W/lb) | (VA/lb) |
| Example II | | | | | | | | | |
| As-Annealed | 14.0 | 12.0 | .042 | .050 | .060 | .095 | .170 | .153 | 2.10 |
| Aged 20 Days | 14.1 | 12.1 | .048 | .054 | .067 | .101 | .207 | .157 | 2.26 |
| Percent Impairment | | | | 8% | 12% | 6% | 22% | 3% | 8% |
| Example III | | | | | | | | | |
| As-Annealed | 14.2 | 12.0 | .040 | .040 | .053 | .084 | .138 | .132 | 1.98 |
| Aged 20 Days | 14.3 | 12.4 | .035 | .044 | .054 | .086 | .129 | .137 | 1.91 |
| Percent Impairment | | | | 10% | 2% | 2% | −6% | 4% | −4% |
| Example IV | | | | | | | | | |
| As-Annealed | 12.4 | 9.8 | .042 | .070 | .106 | .112 | .857 | .162 | 4.8 |
| Aged 20 Days | 12.3 | 9.6 | .039 | .070 | .115 | .113 | .898 | .164 | 4.9 |
| Percent Impairment | | | | 0% | 8% | 1% | 4% | 1% | 2% |

In the alloy of the present invention, certain incidental impurities, or residuals, may be present. Such incidental impurities should not exceed a total of about 0.2 atomic percent of the entire alloy composition, and preferably below about 0.1 atomic percent. In particular, the following maximum residual levels are permissible incidental impurities for various elements in the alloy strip of the present invention:

| Element | Maximum Atomic Percent |
|---|---|
| tin | 0.001 |
| aluminum | 0.10 |
| titanium | 0.007 |
| molybdenum | 0.035 |
| phosphorus | 0.008 |
| nickel | 0.036 |
| manganese | 0.12 |
| copper | 0.03 |
| magnesium | 0.001 |

-continued

| Element | Maximum Atomic Percent |
|---|---|
| calcium | 0.001 |
| sodium | 0.003 |
| potassium | 0.001 |
| chromium | 0.06 |
| lead | 0.01 |
| nitrogen | 0.015 |
| oxygen | 0.086 |
| carbon | 0.08 |
| sulfur | 0.02 |

Certain of the above minor amounts of residual elements and combinations of residual elements may enhance the various magnetic, electrical and/or physical properties of the strip of the present invention without detrimental side effects.

Whereas, the preferred embodiments of the present invention have been described above for purposes of illustration, it will be apparent to those skilled in the art that certain variations of the details may be made without departing from the invention.

We claim:

1. A metal alloy which is at least 75% amorphous consisting essentially of a composition having the formula $Fe_aSi_bB_c$ wherein "a", "b", and "c" are atomic percentages ranging from about 79 to less than 80, 5 to 10, and 12 to 16, respectively, with the proviso that the sum of "a", "b", and "c" equals 100, said alloy having a power loss of less than about 0.22 W/kg (0.10 W/lb.) and an exciting power not greater than about 0.44 VA/kg (0.20 VA/lb), as measured at 60 Hz and at a induction value within 1.0–1.5 tesla.

2. The alloy as set forth in claim 1 wherein "b" and "c" are 5 to 7 and 13 to 15, respectively.

3. The alloy as set forth in claim 1 wherein "b" and "c" are 5.8 to 8.5 and 12.4 to 15.3, respectively.

4. The alloy as set forth in claim 1 which exhibits less than 5% increase in watts per pound core loss at 15 kilogauss after thermal aging at a temperature of 100° C. for up to 2300 hours.

5. The alloy as set forth in claim 1 which exhibits less than 13.5% increase in exciting power at 15 kilogauss after thermal aging at a temperature of 100° C. for up to 2300 hours.

6. The alloy as set forth in claim 1 having a saturation magnetization of at least 15 kilogauss.

7. The alloy as set forth in claim 1 being useful in electrical transformers.

8. The alloy as set forth in claim 1 wherein the alloy is in the form of a wound core.

9. The alloy as set forth in claim 1 wherein the alloy is in the form of strip or ribbon.

10. An amorphous metal consisting essentially of a composition having the formula $Fe_aSi_bB_c$ wherein "a", "b", and "c" are atomic percentages ranging from about 79 to less than 80, 5.8 to 8.5, and 12.4 to 15.3, respectively, with the proviso that the sum of "a", "b", and "c" equals 100, said alloy having a power loss of less than about 0.22 W/kg (0.10 W/lb.) and an exciting power not greater than about 0.44 VA/kg (0.20 VA/lb), as measured at 60 Hz and at an induction value within 1.0–1.5 tesla.

11. An amorphous metal alloy for electrical transformer use consisting essentially of a composition having the formula $Fe_aSi_bB_c$ wherein "a", "b", and "c" are atomic percentages ranging from about 79 to less than 80, 5.8 to 8.5, and 12.4 to 15.3, respectively, with the proviso that the sum of "a", "b", and "c" equals 100, said alloy having a power loss of less than about 0.22 W/kg (0.10 W/lb) and an exciting power not greater than about 0.44 VA/kg (0.20 VA/lb), measured at 60 Hz at an induction of 1.26 T and a saturation magnetization of at least 15 kilogauss, and having less than 5% increase in core loss at 15 kilogauss after thermal aging at 100° for up to 2300 hours.

12. The amorphous alloy of claim 1 wherein said power loss and exciting power are measured at either 1.0 tesla, 1.26 tesla, or 1.5 tesla.

13. The amorphous alloy of claim 1, wherein said power loss and exciting power are measured at room temperature.

14. The amorphous alloy of claim 1, wherein said power loss and exciting power are measured at either 1.0 tesla, 1.26 tesla, or 1.5 tesla and at room temperature.

15. The amorphous alloy of claim 10, wherein said power loss and exciting power are measured at either 1.0 tesla, 1.26 tesla, or 1.5 tesla.

16. The amorphous alloy of claim 10, wherein said power loss and exciting power are measured at room temperature.

17. The amorphous alloy of claim 10, wherein said power loss and exciting power are measured at either 1.0 tesla, 1.26 tesla, or 1.5 tesla and at room temperature.

* * * * *

UNITED STATES PATENT AND TRADEMARK OFFICE

CERTIFICATE OF CORRECTION

PATENT NO. : 5,370,749

DATED : December 6, 1994

INVENTOR(S) : S. Leslie Ames and Vilakkudi G. Veeraraghavan

It is certified that error appears in the above-indentified patent and that said Letters Patent is hereby corrected as shown below:

Column 1, lines 52-53, delete "$M_{60-}90Y_{10-30}Z0.1-15$" and substitute -- $M_{60-90}Y_{10-30}Z_{0.1-15}$ --

Column 3, lines 64-65, delete " Centrigrade" and substitute -- Centigrade --

Column 6, line 22, third column (under Si heading), delete "9.4" and substitute -- 8.4 --

Columns 9-10, Table I, sixth entry under column headed $^{6}_{1008}$, delete "0.0519" and substitute -- 0.0518 --

Signed and Sealed this

Seventh Day of February, 1995

*Attest:*

BRUCE LEHMAN

*Attesting Officer*

*Commissioner of Patents and Trademarks*